US008420962B2

(12) United States Patent
Dodal et al.

(10) Patent No.: US 8,420,962 B2
(45) Date of Patent: Apr. 16, 2013

(54) VENTED ELECTRCAL ENCLOSURE WITH OPERATION HANDLE

(75) Inventors: Rohit Sumerchand Dodal, Peachtree City, GA (US); Chadwick Garfield Smith, Flowery Branch, GA (US)

(73) Assignee: Cooper Technologies Company, Houston, TX (US)

( * ) Notice: Subject to any disclaimer, the term of this patent is extended or adjusted under 35 U.S.C. 154(b) by 247 days.

(21) Appl. No.: 12/825,140

(22) Filed: Jun. 28, 2010

(65) Prior Publication Data

US 2011/0011710 A1 Jan. 20, 2011

Related U.S. Application Data

(60) Provisional application No. 61/226,961, filed on Jul. 20, 2009.

(51) Int. Cl.
*H01H 9/20* (2006.01)

(52) U.S. Cl.
USPC ..... 200/50.02

(58) Field of Classification Search ..... 200/302.1, 200/50.11, 50.02, 50.01
See application file for complete search history.

(56) References Cited

U.S. PATENT DOCUMENTS

| | | | | |
|---|---|---|---|---|
| 2,695,934 | A * | 11/1954 | Wills | 200/50.19 |
| 3,335,238 | A * | 8/1967 | Zavertnik et al. | 200/50.06 |
| 3,735,078 | A * | 5/1973 | Appleton et al. | 200/50.3 |
| 3,832,503 | A | 8/1974 | Crane | |
| 4,791,258 | A * | 12/1988 | Youtz et al. | 200/302.1 |
| D321,339 | S | 11/1991 | Stack et al. | |
| 6,762,662 | B2 * | 7/2004 | Lee et al. | 335/2 |
| D513,496 | S | 1/2006 | Ikegami | |
| D526,968 | S | 8/2006 | Castaldo | |
| D559,795 | S | 1/2008 | Valentin et al. | |
| 2010/0032278 | A1 | 2/2010 | Lin | |
| 2011/0011710 | A1 | 1/2011 | Dodal et al. | |

* cited by examiner

*Primary Examiner* — Vanessa Girardi
(74) *Attorney, Agent, or Firm* — King & Spalding LLP

(57) ABSTRACT

An enclosure described herein satisfies the requirements of a NEMA 4X enclosure, and is capable of being used in food and beverage plants, and other washdown environments. The enclosure includes a housing and a removable cover coupled to the enclosure. The cover is flush with the housing, and both the housing and the cover have a smooth exterior finish. A sealing gasket having a thickness greater than the cover is positioned between the cover and the housing. The enclosure generally houses at least one switch therein. The cover includes a handle and switch mechanism that controls the switch(es) when the cover is coupled to the housing.

19 Claims, 5 Drawing Sheets

VENTED ELECTRCAL ENCLOSURE WITH OPERATION HANDLE

CROSS-REFERENCE TO RELATED APPLICATION

The present application claims priority under 35 U.S.C. §119(e) to U.S. Provisional Patent Application No. 61/226,961, titled "NEMA 4X Enclosure" filed on Jul. 20, 2009, the entire disclosure of which is hereby fully incorporated herein by reference.

TECHNICAL FIELD

The invention relates generally to enclosures for use in industrial environments. More particularly, the invention relates to an electrical box enclosure for use in food processing splash zone areas and other washdown environments.

BACKGROUND OF THE INVENTION

Food and beverage manufacturing and distribution facilities, such as meat-packing plants or distilleries, typically have areas that need to be hosed down with water in order to clean the area in a satisfactory manner. In certain instances, food or beverage particles are deposited on an electrical enclosure during processing or deposited on the electrical enclosure during the hose-down process and end up sticking to an exterior or within a crevice of the electrical enclosure, thus increasing the potential for bacterial growth on the enclosure. During inspection of the facilities, a health inspector may shut down the plant if such food particles and/or bacterial growth are found on the electrical enclosure.

SUMMARY OF THE INVENTION

The present invention provides enclosures that can generally prevent or substantially limit food and other particles from adhering to an exterior of the enclosure, along a joint, or along a mating area of the enclosure, and allow for easy removal with water. In one aspect of the invention, an enclosure for use in a food and beverage plant can include a back panel, a front wall, and four side walls defining a housing. The back panel and four side walls can be arranged in a rectangular shape to form an interior space within the housing. The front wall includes an opening to provide access to the interior space. The enclosure can also include a cover removably coupled to the housing. The cover can have a front panel and four side walls extending from the front panel. A perimeter of the front panel of the cover is substantially equal to a perimeter of the front wall of the housing. A gasket can be included along an outer perimeter of the front panel of the cover and adjacent to the four side walls of the cover, between the cover and the housing. The cover and the housing can have a smooth exterior finish. The gasket can have a thickness greater than a height of a side wall of the cover. The enclosure can also include a toggle switch within the interior space of the housing. A mechanical switch mechanism can engage the toggle switch when the cover is couple to the housing, such that when the mechanical switch mechanism is in the on position, the toggle switch is in the on position, and when the mechanical switch mechanism is in the off position, the toggle switch is in the off position. The housing can also include an optional auxiliary switch that is actuated by the mechanical switch mechanism such that when the mechanical switch mechanism is in the on position, the mechanical switch mechanism actuates the auxiliary switch.

In another aspect, an enclosure is defined that includes a back panel, a front panel, and four side walls defining a housing. The back panel and four side walls can be arranged in a rectangular shape to form an interior space within the housing. The front panel includes an opening to provide access to the interior space. The enclosure can also include a cover removably coupled to the housing. The cover can have a base wall and four extensions extending from the front panel. A perimeter of the base wall of the cover is substantially equal to a perimeter of the front panel of the housing. The cover and the housing can have a smooth exterior finish.

In yet another aspect, a system is defined that includes an enclosure of the present invention having a switch positioned therein. The switch is movable between an on position and an off position, and is controlled by a handle and switch mechanism on the front panel or cover of the enclosure.

These and other aspects, objects, features, and embodiments of the present invention will become apparent to those having ordinary skill in the art upon consideration of the following detailed description of illustrative embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings, which are described below.

Figure 1A:
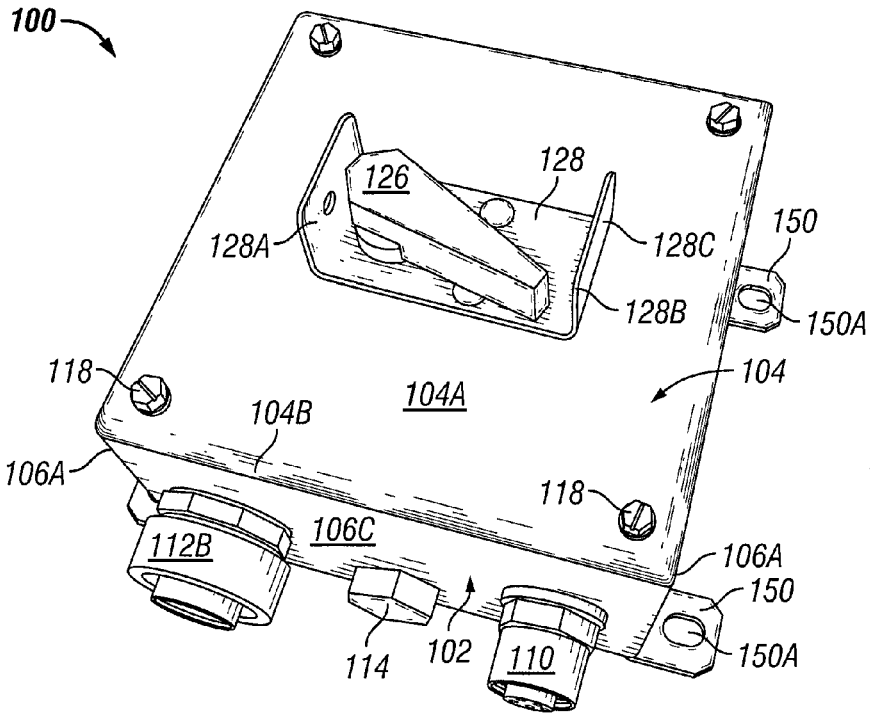
FIG. 1A is a perspective view of an enclosure with the handle in the "off" position according to an exemplary embodiment.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements.

DETAILED DESCRIPTION OF THE INVENTION

The exemplary enclosures described herein have significant improvements over conventional enclosures used in food processing splash zone areas and other washdown environments. The enclosures described generally prevent or substantially limit food and other particles from adhering to an exterior along a joint or along a mating area of the enclosure, and allow for easier removal with water. The invention may be better understood by reading the following description of non-limitative, exemplary embodiments with reference to the attached drawings wherein like parts of each of the figures are identified by the same reference characters.

Figure 1B:
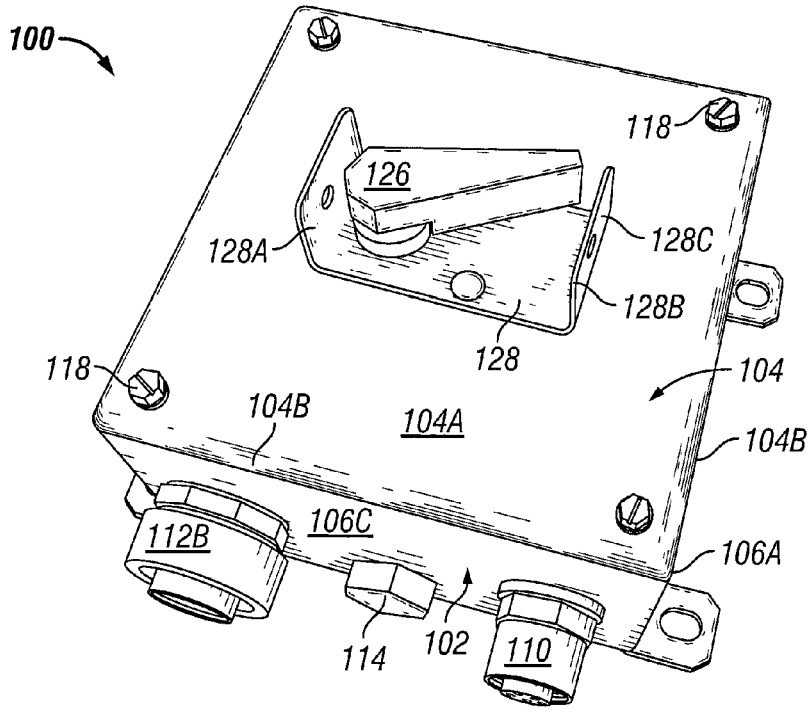
FIG. 1B is another perspective view of the enclosure of FIG. 1A with the handle in the "on" position according to one exemplary embodiment.
Figure 1C:
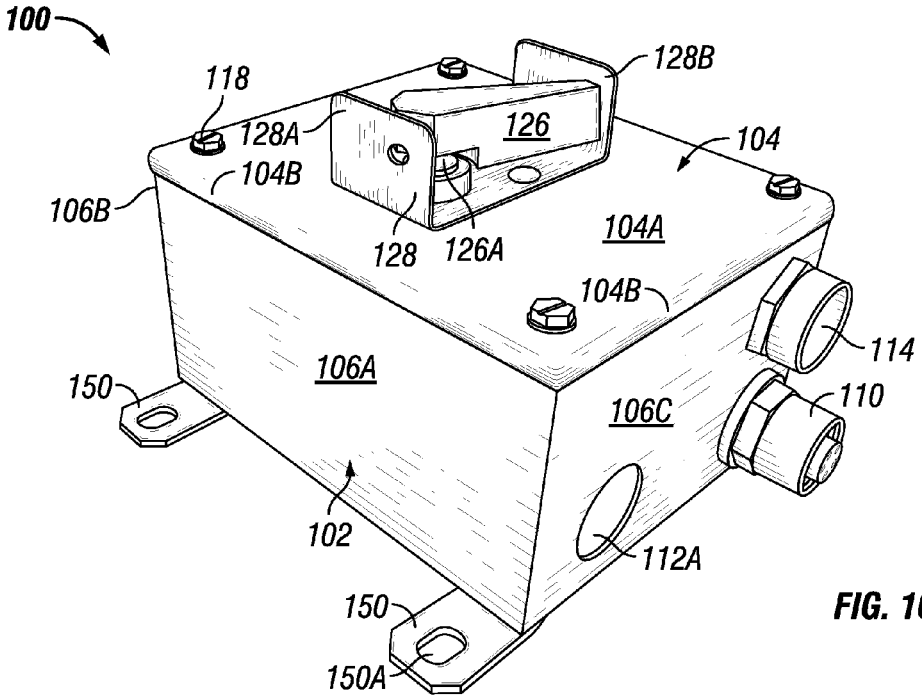
FIG. 1C is a bottom perspective view of the enclosure of FIG. 1A according to one exemplary embodiment.
Figure 1D:
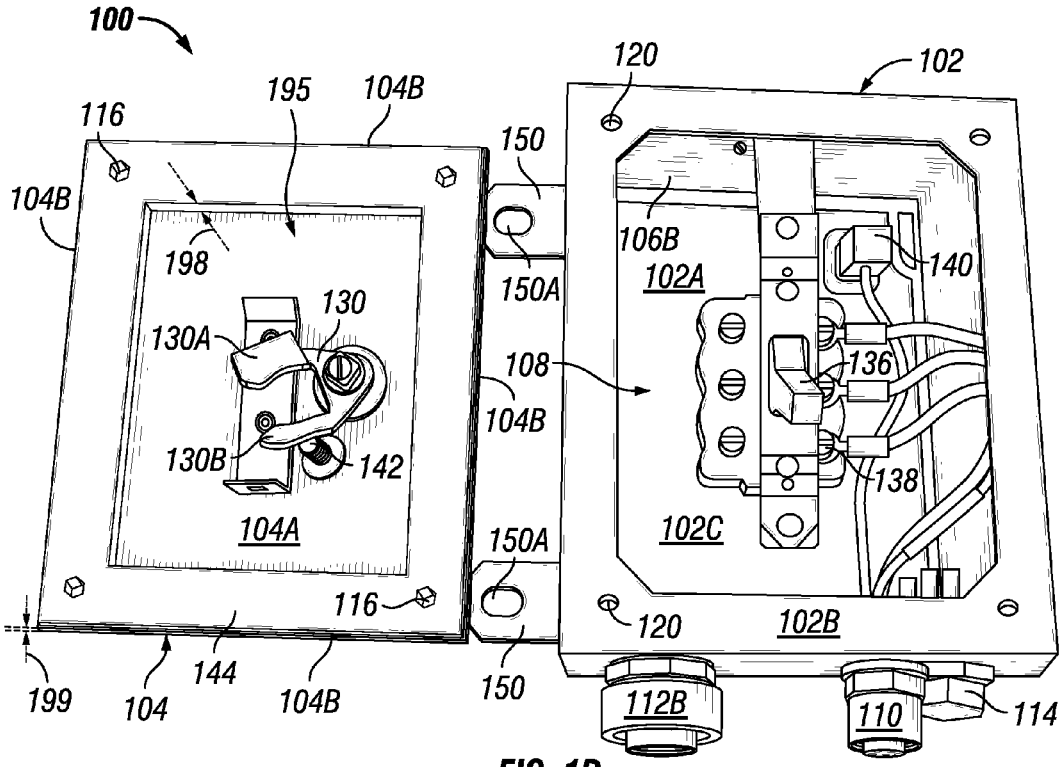
FIG. 1D is an exploded view of the enclosure of FIG. 1A, showing the interior components, according to one exemplary embodiment.

FIGS. 1A and 1B are perspective views of an enclosure 100 according to one exemplary embodiment. FIG. 1C is a bottom perspective view of the exemplary enclosure 100. FIG. 1D is an exploded interior view of the exemplary enclosure 100. Referring to FIGS. 1A-D, the exemplary enclosure 100 includes a housing 102 and a cover 104. In certain exemplary embodiments, the housing 102 and cover 104 are each constructed of stainless steel and have a smooth or substantially smooth exterior finish. The housing 102 includes two side walls 106*a*, an upper wall 106*b* (FIG. 1D), and a lower wall 106*c*, collectively referred to herein as side walls 106, arranged in a rectangular shape. In certain embodiments, the exterior mating surfaces between each of the side walls 106 is slightly curved, and has a radius of curvature in the range of from about 0.020 inch to about 0.100 inch. In one exemplary embodiment, the exterior mating surfaces between each of the side walls 106 has a radius of curvature about 0.060 inch. The housing 102 also includes a back wall 102*a* (FIG. 1D) that is coupled to and disposed orthogonally to the side walls 106, and a front wall 102*b* (FIG. 1D) that is coupled to and disposed orthogonally to the side walls 106 opposing the back wall 102*a*. The side walls 106 and the back wall 102*a* define a cavity 108 (FIG. 1D) of the housing 102. The front wall 102*b* includes an opening 102*c* (FIG. 1D) providing access to the cavity 108.

The enclosure 100 includes a power connection 110 at the lower wall 106*c* of the housing 102. In one exemplary embodiment, the power connection 110 is wired with SOFT-Power™ connection points for easy connection and change-outs that reduce downtime, easier maintenance, and increased safety using the plug-and-run modular pre-wired system. Those of ordinary skill in the art will recognize that the present invention is not limited to the power connection presented in FIG. 1D. Instead, the exemplary power connection 110 is capable of having multiple input and output configurations. The exemplary enclosure 100 also includes an aperture 112*a* (See FIG. 1C) in and through the lower wall 106*c* of the housing 102. In certain exemplary embodiments, a fitting 112*b* is coupled to the aperture 112*a*. In one exemplary embodiment, the fitting 112*b* is a National Electrical Manufacturers Association (NEMA®) 4X ¾" liquid-tight fitting. In certain additional embodiments, the lower wall 106*c* also includes an a second aperture (not shown) for additional power connections. The enclosure 100 also includes a breather drain 114 coupled to the lower wall 106*c*. The exemplary breather drain 114 allows air within the housing 102 to "breathe" with the surrounding atmosphere outside of the housing 102. The breather drain 114 also helps equalize the pressure inside the enclosure 100 and helps prevent condensation buildup within the housing 102.

The cover 104 includes a front panel 104*a* having four side walls 104*b* extending from a perimeter of the front panel 104*a*. The exterior mating surfaces between each of the side walls 104*b* is slightly curved, and has a radius of curvature equal to or substantially equal to the radius of curvature of the exterior mating surfaces between the side walls 106 of the housing 102. The side walls 104*b* and the front panel 104*a* define an interior space 195 (FIG. 1D) of the cover 104. In certain exemplary embodiments, the cover 104 of the enclosure 100 is sized such that when coupled to the housing 102, the side walls 104*b* of the cover 104 are flush or substantially flush with the housing 102. Having a perimeter of the cover 104 being equal or substantially equal to a perimeter of the housing 102, without the side walls 104*b* of the cover 104 overlapping the perimeter of the housing 102, substantially eliminates the presence of crevices adjacent to the mating surface between the cover 104 and the housing 102. The presence of a gasket 144 (FIG. 1D) further eliminates the presence of crevices adjacent to the mating surface between the cover 104 and the housing 102. The cover 104 being flush with the housing 102, along with the presence of the gasket 144 between the mating surface between the cover 104 and the housing 102, prevent any water from entering the cavity 108 of the enclosure 100 during a hose-down operation.

The cover 104 includes two or more apertures 116 (See FIG. 1D) positioned near the perimeter of the cover 104. In one exemplary embodiment, the cover 104 includes four apertures 116 and each of the apertures 116 is a through-hole that receives a fastener 118. Alternatively, the apertures 116 are threaded to receive a fastener 118. The enclosure 100 includes four fasteners 118 for coupling the cover 104 to the housing 102 through the apertures 116 in the cover 104 and apertures 120 in the housing 102 (see FIG. 1D). In one exemplary embodiment, the apertures 120 are threaded to receive the fasteners 118. In one exemplary embodiment, the fasteners 118 are quick-drive hex cover bolts with washers, however, other fasteners known to those of ordinary skill in the art, including, but not limited to, screws, bolts and rivets, can be used. The washers of the fasteners 118 secure the cover 104 to the housing 102 and aid in preventing any water from entering the cavity 108 of the enclosure 100 during a hose-down operation. The fasteners 118 also provided a removable cover 104 to allow access to the cavity 108 of the housing 102. In one embodiment, the apertures 116, 118 are equally disposed in each corner of the cover 104 and front wall 102*b*, respectively. In alternative embodiments, as shown in FIG. 2D, two of the apertures 116, 118 are offset in each corner of the cover 104 and the front wall 102*b* to prevent a user from incorrectly securing the cover 104 to the housing 102.

Referring to FIGS. 1A-1C, the exemplary enclosure 100 includes a high-visibility handle 126 having a shaft 126*a* (FIG. 1C) rotatably coupled to the cover 104 by a handle mounting bracket 128 and held in place by a retaining ring 126*b* (FIG. 1D). In one exemplary embodiment, the handle 126 includes two o-rings (not shown) on the shaft 126*a* to prevent any water from entering the enclosure 100 during a hose-down operation. The handle 126 is rotatable between an "off" position (FIG. 1A) and an "on" position (FIG. 1B). In one exemplary embodiment, the handle mounting bracket 128 also includes two extensions 128*a*, 128*b*. The extensions 128*a*, 128*b* extend in an orthogonal or substantially orthogonal manner outward from the cover 104 and past the handle 126 when the handle 126 is rotatably coupled to the cover 104, so as to prevent damage to the handle 126. The extension 128*a* is positioned on the end of the handle mounting bracket 128 adjacent the axis of rotation of the handle 126. The extension 128*b* is positioned on an opposing end of the mounting bracket 128 from the extension 128*a* and includes an aperture 128*c*. The aperture 128*c* has a diameter such that the handle 126 can be padlocked or tonged to meet Occupational Safety and Health Administration ("OSHA") lockout/tagout requirements. In certain exemplary embodiments, when the handle 126 is in the "off" position (FIG. 1A), a padlock (not shown) is inserted through the aperture 128*c* to prevent the handle 126 from turning to the "on" position. In certain exemplary embodiments, when the handle 126 is in the "on" position (FIG. 1B), a padlock can be inserted through the aperture 128*c* to prevent the handle from turning to the "off" position. In certain embodiments, the handle 126 is a highly-visible color, such as red.

Referring now to FIG. 1D, the cover 104 of the enclosure 100 includes a mechanical switch mechanism 130 operably coupled to the handle 126 (FIGS. 1A-1C) for rotatable movement about an axis. The housing 102 includes a conventional switch 136 operably adjusted from an "on" to an "off" position (and vice-versa) by the handle 126 and two operating forks 130*a*, 130*b* of the mechanical switch mechanism 130 when the cover 104 is coupled to the housing 102. The operating forks 130*a*, 130*b* are spaced a distance apart and are sized such that the switch 136 can be positioned between the two operating forks 130*a*, 130*b*. In one exemplary embodiment, the operating fork 130*a* is larger in size than the operating fork 130*b*. The size of the operating fork 130*a* is such that when the switch 136 is in the "on" position, the handle 126 must be in the "on" position for the cover 104 to be assembled to the housing 102 since the switch 136 cannot occupy the same space as the operating fork 130*a*, and similarly, when the switch 136 is in the "off" position, the handle 126 must be in the "off" position for the cover 104 to be assembled. Upon turning the handle 126 from one position to another, thereby shifting the operating forks 130*a*, 130*b* of the mechanical switch mechanism 130, the switch 136 can then be shifted from one position to another. In certain embodiments, the switch 136 is a toggle switch. In certain exemplary embodiments, the switch 136 is a heavy-duty industrial 3-pole, 3-phase, 30 Amp, 600 V, 15 HP switch. The housing 102 also includes fork terminals 138 for easy phase changes. The housing 102 further includes a fixed grounding lug 140 for ground continuity.

The cover 104 includes a rotation limiting post 142 extending from the front panel 104*a* on the interior side of the cover 104. In one exemplary embodiment, the rotation limiting post 142 is a round bar that extends orthogonally from the front panel 104*a* of the cover 104*a* and has a diameter of about 0.250 inch. The rotation limiting post 142 is positioned on the "off" side of the mechanical switch mechanism 230. Generally, the rotation limiting post 142 limits the rotation of the operating forks 130*a*, 130*b* of the mechanical switch mechanism 130 in the "off" position. The rotation limiting post 142 is positioned such that when the switch 136 is in the "on" position, the handle 126 must be in the "on" position for the cover 104 to be assembled to the housing 102 since the operating fork 130*a* will interfere with the toggle switch 136, and similarly, when the switch 136 is in the "off" position, the handle 126 must be in the "off" position for the cover 104 to be assembled.

In certain embodiments, the cover 104 also includes a gasket 144. The exemplary gasket 144 is coupled to the front panel 104*a* of the cover 104 and disposed along the outer perimeter of the front panel 104*a* and adjacent to the side walls 104*b* of the cover 104. In one exemplary embodiment, the thickness 198 of the gasket 144 is greater than a height 199 of the side walls 104*b* of the cover 104. The gasket 144 sits taller than the cover 104, and once assembled, seals any openings between the housing 102 and the cover 104. The presence of the gasket 144 substantially eliminates the presence of any crevices adjacent to the mating surface between the cover 104 and the housing 102. In one exemplary embodiment, the gasket 144 is a food-rated molded silicone gasket that provides a waterproof barrier between the cover 104 and the housing 102 and allows for use of pressurized water during cleaning of the exterior of the enclosure 100 while protecting the internal components within the enclosure 100.

Referring again to FIGS. 1A-D, the enclosure 100 further includes four enclosure mounting brackets 150. Each enclosure mounting bracket 150 extends orthogonally out from a side wall 106*a* or extends along the lateral axis of the back side 102*a* of the enclosure 100. The enclosure mounting brackets 150 are secured to the side walls 106*a* or back wall 102*a* by any means known to one having ordinary skill in the art. In one exemplary embodiment, the enclosure mounting brackets 150 are welded to the housing 102. Each enclosure mounting bracket 150 includes an aperture 150*a* in the portion extended portion. The apertures 150*a* are sized to receive a securing means (not shown), such as a bolt or screw, for attaching the enclosure 100 to a wall (not shown) or other mounting surface. While the exemplary embodiment in FIGS. 1A-D presents four mounting brackets 150, fewer or greater numbers of mounting brackets 150 are alternatively coupled to the housing 102. In one exemplary embodiment, the enclosure 100 satisfies the requirements of a NEMA 4X enclosure, and is intended for indoor or outdoor use primarily to provide a degree of protection against corrosion, wind-blown dust and rain, splashing water, and hose directed water, and is undamaged by ice which may form on the enclosure. The enclosure 100 is ideal for washdown environments. As used herein, the term "washdown environment" refers to an environment in which waste materials and residues from processing systems and controls must be removed with the use of water or other liquid.

Figure 2A:
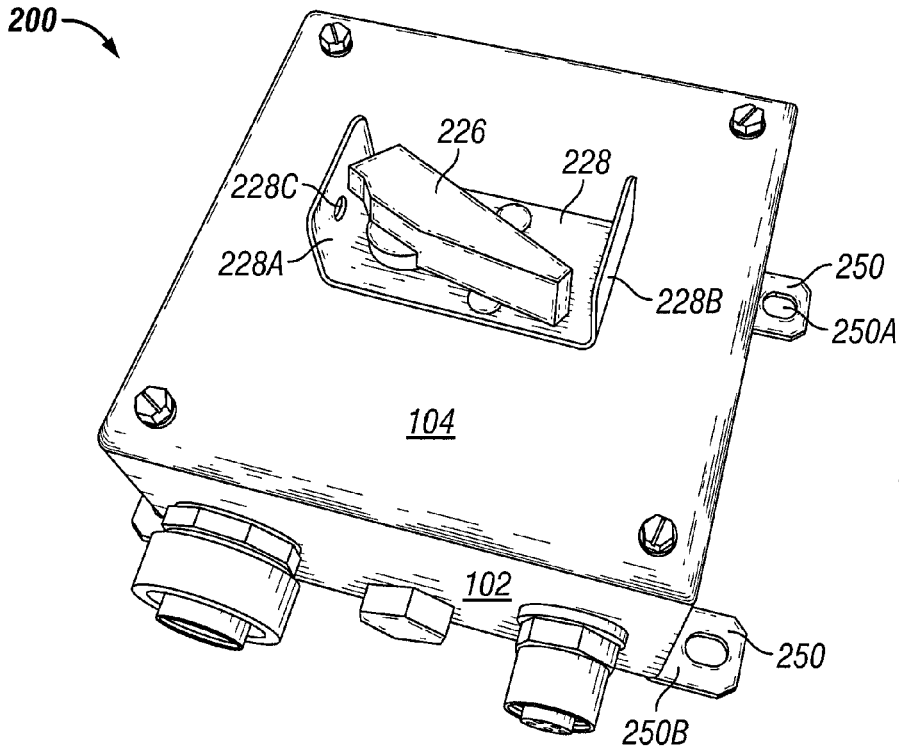
FIG. 2A is a perspective view of an enclosure with the handle in the "off" position according to another exemplary embodiment.
Figure 2B:
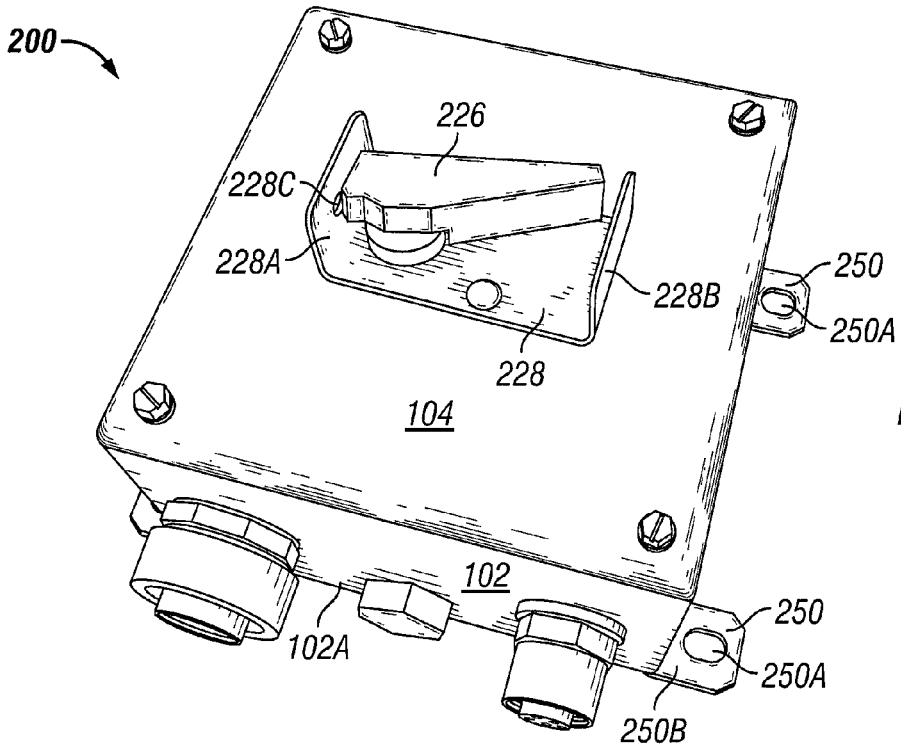
FIG. 2B is another perspective view of the enclosure of FIG. 2A with the handle in the "on" position according to one exemplary embodiment.
Figure 2C:
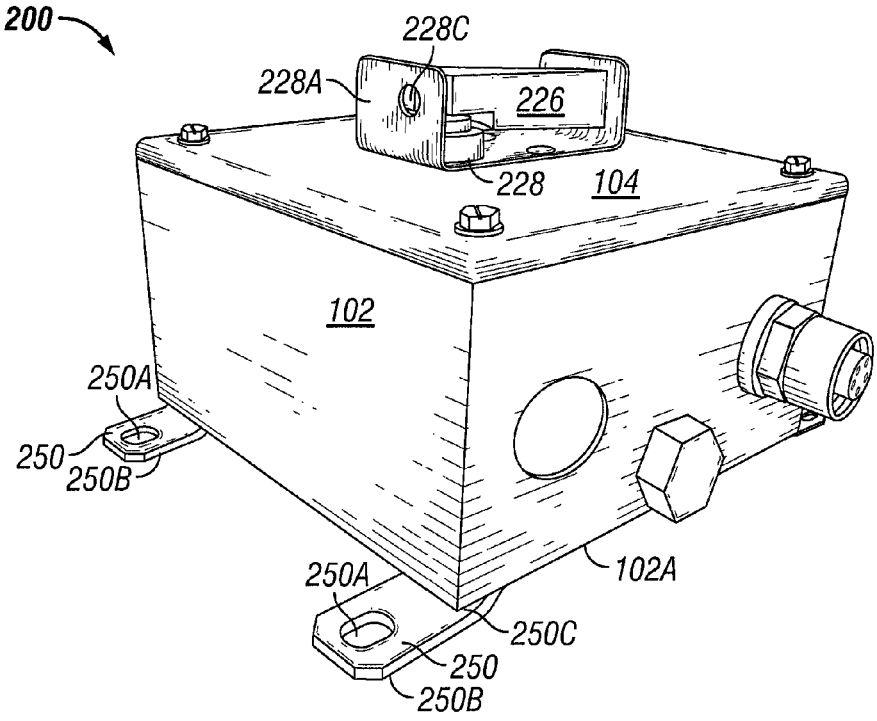
FIG. 2C is a bottom perspective view of the enclosure of FIG. 2A according to one exemplary embodiment.
Figure 2D:
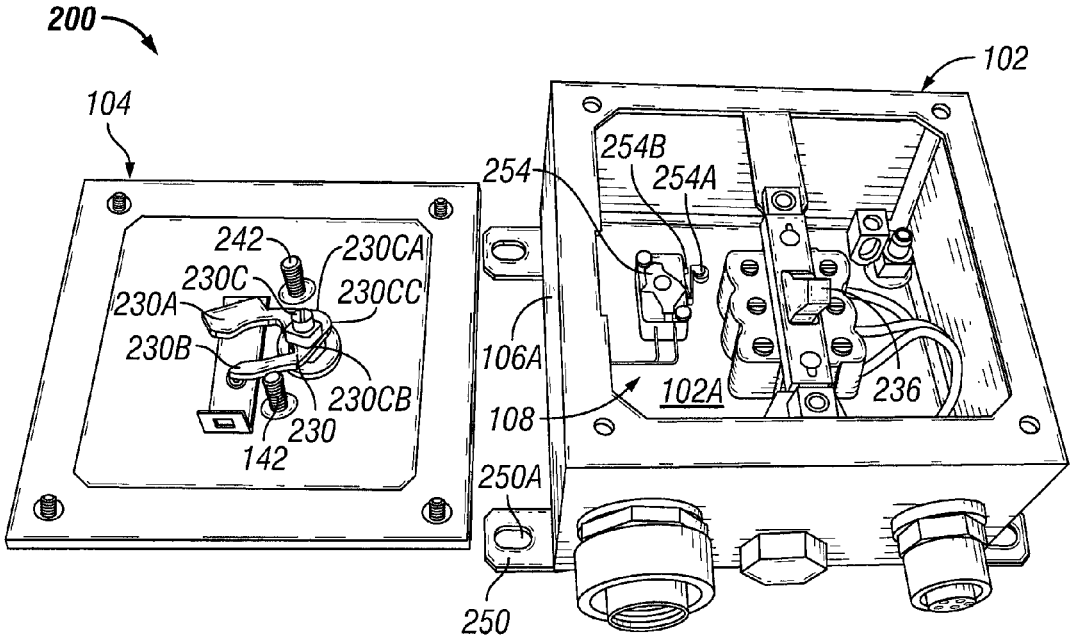
FIG. 2D is an exploded view of the enclosure shown in FIG. 2A, showing the interior components, according to one exemplary embodiment.
Figure 2E:
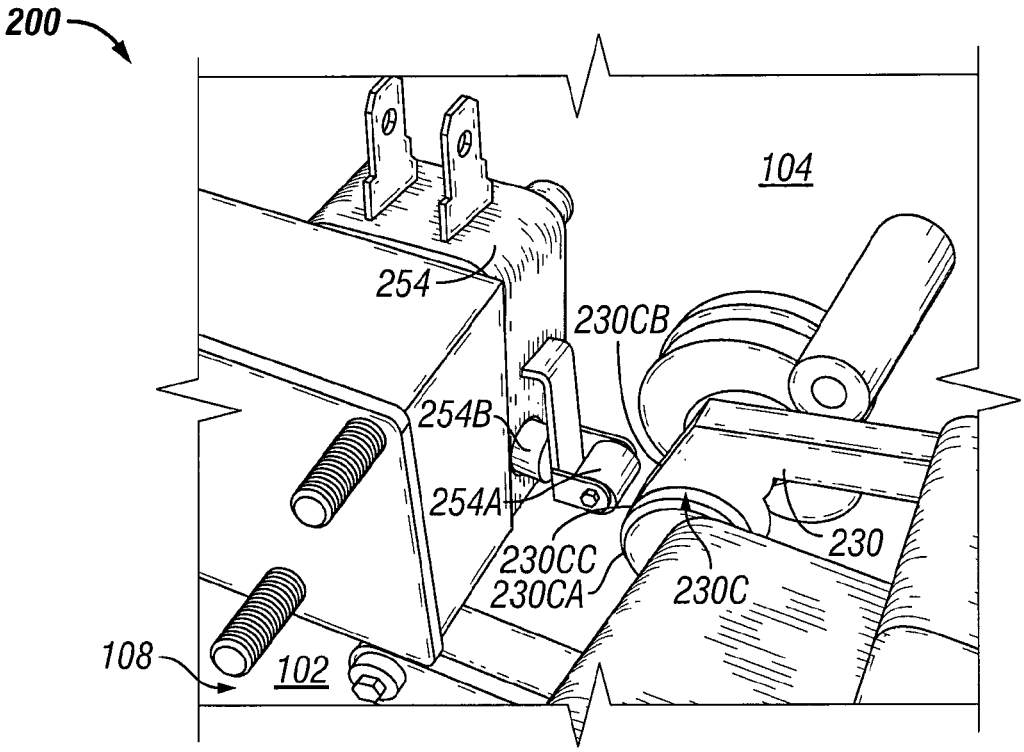
FIG. 2E is a partial view of the interior of the enclosure shown in FIG. 2A, according to one exemplary embodiment.
Figure 2F:
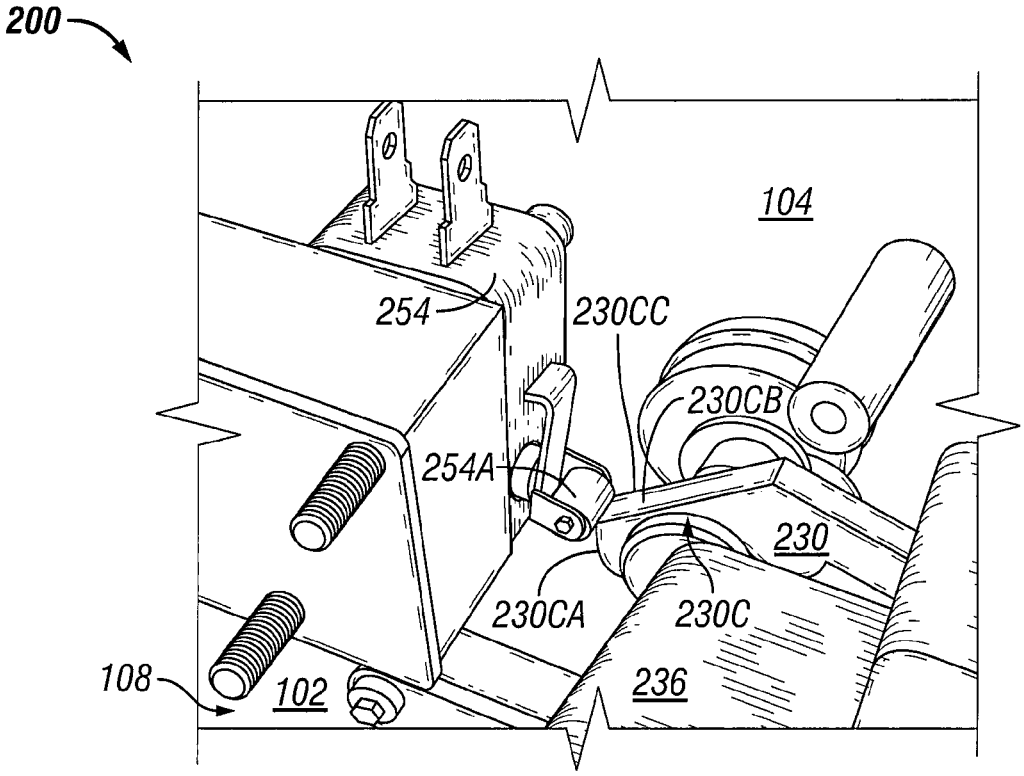
FIG. 2F is a partial view of the interior of the enclosure shown in FIG. 2B, according to one exemplary embodiment.

FIGS. 2A and 2B are perspective views of an enclosure 200 according to one exemplary embodiment. FIG. 2C is a bottom perspective view of the exemplary enclosure 200. FIG. 2D is an exploded interior view of the exemplary enclosure 200. FIGS. 2E and 2F are partial views of the interior of the enclosure 200. The enclosure 200 is the same as that described above with regard to FIGS. 1A-1D, except as specifically stated below, and for the sake of brevity the similarities will not be repeated hereinbelow.

Referring to FIGS. 2A-2C, the enclosure 200 includes a high-visibility handle 226 rotatably coupled to the cover 104 by a handle mounting bracket 228. The handle 226 is rotatable between an "off" position (FIG. 2A) and an "on" position (FIG. 2B). In one exemplary embodiment, the handle mounting bracket 228 includes two extensions 228*a*, 228*b*. The extension 228*a* is positioned on the end of the handle mounting bracket 228 adjacent the axis of rotation of the handle 226. The extension 228*a* includes an aperture 228*c* such that the handle 226 can be padlocked or tonged to meet Occupational Safety and Health Administration ("OSHA") lockout/tagout requirements. In certain embodiments, when the handle 226 is in the "off" position (FIG. 2A), a padlock (not shown) can be inserted through the aperture 228*c* to prevent the handle from turning to the "on" position. In certain embodiments, when the handle 226 is in the "on" position (FIG. 2B), a padlock cannot be inserted through the aperture 228*c*, as access to the aperture 228*c* is blocked by the handle 226, thereby allowing a user to turn the handle to the "off" position. In certain embodiments, the handle 226 is a highly-visible color, such as red.

Referring to FIG. 2D, the cover 104 of the enclosure 200 includes a mechanical switch mechanism 230 operably coupled to the handle 226 (FIGS. 2A-2C) for rotatable movement about an axis. The cover 104 also includes two rotation limiting posts 142, 242 that limit the rotation of the mechanical switch mechanism 230 in the "off" and "on" positions, respectively. The rotation limiting post 242 is similar to the rotation limiting post 142. The rotation limiting posts 142, 242 are positioned on the "off" and "on" sides, respectively, of the mechanical switch mechanism 230 such that when the switch 236 is in the "on" position, the handle 226 must be in the "on" position for the cover 104 to be assembled to the housing 102, and when the switch 236 is in the "off" position, the handle 226 must be in the "off" position for the cover 104 to be assembled.

The housing 102 includes a conventional switch 236 operably adjusted from an "on" to an "off" position (and vice-versa) by the handle 226 and two operating forks 230*a*, 230*b* of the mechanical switch mechanism 230 when the cover 104 is coupled to the housing 102. The operating forks 230*a*, 230*b* are spaced a distance apart and are sized such that the switch 236 can be positioned between the two operating forks 230*a*, 230*b*. In one exemplary embodiment, the operating fork 230*a* is larger in size than the operating fork 230*b*. The size of the operating fork 230*a* is such that when the switch 236 is in the "on" position, the handle 226 must be in the "on" position for the cover 104 to be assembled to the housing 102 since the switch 236 cannot occupy the same space as the operating fork 230*a*, and similarly, when the switch 236 is in the "off" position, the handle 226 must be in the "off" position for the cover 104 to be assembled. Upon turning the handle 226 from one position to another, thereby shifting the operating forks 230*a*, 230*b* of the mechanical switch mechanism 230, the switch 236 can then be shifted from one position to another. In one embodiment, the switch 236 is a heavy-duty industrial 3-pole, 3-phase, 40 Amp, 600 V, 20 HP switch. In another embodiment, the switch 236 is a heavy-duty industrial 3-pole, 3-phase, 60 Amp, 600 V, 30 HP switch.

Referring now to FIGS. 2D-2F, the housing 102 also includes an auxiliary switch 254 positioned within the cavity 108 and adjacent to the side wall 106*a* opposite from the switch 236. The auxiliary switch 254 is positioned within the cavity 108 such that a roller 254*a* for operably adjusting the auxiliary switch 254 from an "on" to an "off" position (and vice-versa) engages an actuating end 230*c* of the mechanical switch mechanism 230 when the cover 104 is coupled to the housing 102 and the handle 226 is in the "on" position. In one embodiment, the auxiliary switch 254 is a miniature switch having a rating in the range of about 0.1 Amp to about 25 Amp. The actuating end 230*c* of the mechanical switch mechanism 230 is positioned at an end opposing the operating forks 230*a*, and is configured to engage the roller 254*a* of the auxiliary switch 254 when the handle 226 is in the "on" position. In one exemplary embodiment, the actuating end 230*c* includes two flat sides 230*ca*, 230*cb* that form a protrusion 230*cc*. When the handle 226 is in the "on" position, the protrusion 230*cc* of the actuating end 230*c* of the mechanical switch mechanism 230 depresses the roller 254*a*, thereby depressing a pin plunger 254*b* and turning "on" the auxiliary switch 254, and the operating forks 230*a*, 230*b* adjust the switch 236 to the "on" position thereafter (FIG. 2F). Similarly, when the handle 226 is in the "off" position, the protrusion 230*cc* of the actuating end 230*c* of the mechanical switch mechanism 230 disengages the roller 254*a*, thereby turning "off" the auxiliary switch 254, and the operating forks 230*a* adjust the switch 236 to the "off" position thereafter (FIG. 2E).

Referring again to FIGS. 2A-2D, the enclosure 200 includes four enclosure mounting brackets 250, each coupled to a corner of the back wall 102*a* (FIG. 1D) of the housing 102 by an enclosure mounting portion 250*c*, and having a surface mounting portion 250*b* extending at least partially from a perimeter of the back wall 102*a*. In one exemplary embodiment, the enclosure mounting portion 250*c* is spaced at least about 0.25 inch from the surface mounting portion 250*b*. The enclosure mounting portion 250*c* is secured to the back wall 102*a* by any means known to one having ordinary skill in the art. In one exemplary embodiment, the enclosure mounting brackets 250 are welded to the housing 102. The surface mounting portion 250*b* of enclosure mounting brackets 250 includes an aperture 250*a* sized to receive a securing means (not shown), such as a bolt, for attaching the enclosure 200 to a mounting surface (not shown), such as a wall. The spacing between the enclosure mounting portion 250*c* and the surface mounting portion 250*b* prevent any food particles from being trapped between the enclosure 200 and the mounting surface. In one exemplary embodiment, the enclosure 200 satisfies the requirements of a NEMA 4X enclosure, and is intended for indoor or outdoor use primarily to provide a degree of protection against corrosion, windblown dust and rain, splashing water, and hose directed water, and is undamaged by ice which may form on the enclosure. The enclosure 200 is ideal for washdown environments.

In certain exemplary embodiments, the enclosures 100, 200 are constructed from stainless steel. In other embodiments, the enclosures 100, 200 are constructed from aluminum, mild steel, galvanized steel, copper alloys, vulcanized fiber and molded polymeric material, or the like. In certain embodiments, the enclosures 100, 200 have a shape other than rectangular. One having ordinary skill in the art will recognize that the enclosures 100, 200 may have any shape suitable for use as an enclosure.

The particular embodiments disclosed herein are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit and scope of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention as defined by the claims below. The terms in the claims have their plain, ordinary meaning unless otherwise explicitly and clearly defined by the patentee.

We claim:

1. An enclosure system comprising;

an enclosure comprising:

a housing having a cavity;

a cover removable coupled to the housing, wherein an outer perimeter of the cover is substantially equal to an outer perimeter of the housing when coupled to the housing;

a gasket disposed adjacent the outer perimeter of the cover and the housing, the gasket disposed between the cover and the housing;

a handle rotatably coupled to the cover on an exterior of the cover;

a switch mechanism coupled to the handle on an interior of the cover, and movable between an on position and an off position; and a switch positioned within the cavity of the housing, wherein the switch is movable between an on position and an off position, wherein the switch mechanism engages the switch when the cover is coupled to the housing, and wherein when the switch mechanism is in the on position, the switch is in the on position, and when the switch mechanism is in the off position, the switch is in the off position, wherein the housing further comprises an auxiliary switch positioned within the cavity, wherein when the switch mechanism is in the on position, the switch mechanism actuate the auxiliary switch prior to actuating the switch.

2. The enclosure of claim 1, wherein the switch mechanism comprises two operating forks spaced a distance apart and sized to receive the switch between the operating forks.

3. The enclosure of claim 2, wherein the operating forks are unequal in size.

4. An enclosure system comprising:

an enclosure comprising:

a housing having a cavity;

a cover removable coupled to the housing, wherein an outer perimeter of the cover is substantially equal to an outer perimeter of the housing when coupled to the housing;

a gasket disposed adjacent the outer perimeter of the cover and the housing, the gasket disposed between the cover and the housing;

a handle rotatably coupled to the cover on an exterior of the cover;

a switch mechanism coupled to the handle on an interior of the cover, and movable between an on position and an off position; and a switch positioned within the cavity of the housing, wherein the switch is movable between an on position and an off position, wherein the switch mechanism engages the switch when the cover is coupled to the housing, and wherein when the switch mechanism is in the on position, the switch is in the on position, and when the switch mechanism is in the off position, the switch is in the off position, wherein the switch mechanism comprises two operating forks spaced a distance apart and sired to receive the switch between the operating forks, and wherein the operating forks are unequal in size.

5. An enclosure comprising;

a housing having a back wall, a front wall, and a plurality of first side walls, each first side wall comprising:

a first edge, a second opposing edge, and a substantially planar member disposed between the first and second edge, wherein the first edge is disposed adjacent to the back wall and each first side wall extends out from the back wall in a substantially orthogonal direction, wherein the second edge is disposed adjacent to the front wall, wherein the front wall comprises an opening, wherein the back wall, front wall, and first side walls define a cavity, wherein the opening provides access to the cavity; and a cover comprising a front panel and plurality of second side walls extending orthogonally from the front panel, the cover removably disposed along the front wall, wherein the back wall, first side walls and cover define the enclosure, wherein an outer perimeter of the second side walls is substantially equal to an outer perimeter of the front wall, and wherein the housing and cover have a smooth exterior finish, wherein the housing further comprises a toggle switch positioned therein, the toggle switch being movable between an on position and an off position, and wherein the housing further comprises an auxiliary switch positioned therein, the auxiliary switch being movable between an on position and an off position, wherein when the mechanical switch mechanism is in the on position, the mechanical switch mechanism engages the auxiliary switch thereby actuating the auxiliary switch to the on position, and thereafter actuates the toggle switch to the on position.

6. The enclosure of claim 5, further comprising a gasket disposed along the second edge of each of the first side walls between the front panel and the housing, wherein a thickness of the gasket is greater than a thickness of the cover.

7. An enclosure comprising:

a housing comprising:

a back wall;

a plurality of side walls, each side wall comprising:

a first edge, a second opposing edge, and a substantially planar member disposed between the first and second edge, wherein the first edge is coupled to the back wall and each side wall extends out from the back wall in a substantially orthogonal direction, wherein the back wall and side walls define a cavity;

a front wall coupled to each second edge of the plurality of side walls and extending therefrom in a substantially orthogonal direction, the front wall defining an aperture for access into the cavity; and a toggle switch positioned therein, the toggle switch being movable between an on position and an off position, a cover removably disposed along the front wall, the cover comprising:

a front panel;

a plurality of second walls, each second wall comprising:

a first edge, a second opposing edge, and a substantially planar member disposed between the first and second edge, wherein the first edge is coupled to the front panel and each second wall extends out from the front panel in a substantially orthogonal direction, wherein the front panel and second walls define an interior space, wherein an outer perimeter of the front panel is substantially equal to an outer perimeter of the front wall; and a gasket disposed along the outer perimeter of the front panel adjacent to the second walls and between the cover and the front wall, wherein the front panel further comprises a mechanical switch mechanism rotatably coupled to the front panel and movable between an on position and an off position, wherein the mechanical switch mechanism engages the toggle switch when the front panel is coupled to the housing, wherein the mechanical switch mechanism comprises two operating forks spaced a distance apart and sized to receive the toggle switch between the operating forks, and wherein the operating forks are unequal in size.

8. An enclosure comprising:

a housing comprising:

a back wall;

a plurality of side walls, each side wall comprising:

a first edge, a second opposing edge, and a substantially planar member disposed between the first and second edge, wherein the first edge is coupled to the back wall and each side wall extends out from the back wall in a substantially orthogonal direction, wherein the back wall and side walls define a cavity;

a front wall coupled to each second edge of the plurality of side walls and extending therefrom in a substantially orthogonal direction, the front wall defining an aperture for access into the cavity;

a cover removably disposed along the front wall, the cover comprising:

a front panel;

a plurality of second walls, each second wall comprising:

a first edge, a second opposing edge, and a substantially planar member disposed between the first and second edge, wherein the first edge is coupled to the front panel and each second wall extends out from the front panel in a substantially orthogonal direction, wherein the front panel and second walls define an interior space, wherein an outer perimeter of the front panel is substantially equal to an outer perimeter of the front wall; and a gasket disposed along the outer perimeter of the front panel adjacent to the second walls and between the cover and the front wall, wherein the housing further comprises a toggle switch positioned therein, the toggle switch being movable between an on position and an off position, and wherein the housing further comprises an auxiliary switch positioned therein, the auxiliary switch being movable between an on position and an off position, wherein when the mechanical switch mechanism is in the on position, the mechanical switch mechanism engages the auxiliary switch thereby actuating the auxiliary switch to the on position, and thereafter actuates the toggle switch to the on position.

9. The enclosure of claim 8, wherein the auxiliary switch comprises a depressible roller, wherein when the roller is depressed, the auxiliary switch is actuated, wherein the mechanical switch mechanism comprises two flat sides, wherein an intersection of the two flat sides form a protrusion, wherein the protrusion depresses the roller when the mechanical switch mechanism is in the on position.

10. The enclosure of claim 8, wherein the enclosure comprises a smooth exterior finish.

11. The enclosure of claim 8, further comprising a power connection coupled to one of the walls, the power connection providing a source of electrical power to the cavity.

12. The enclosure of claim 8, further comprising a breather drain at one of the walls.

13. The enclosure of claim 8, wherein a thickness of the gasket is greater than a height of the second walls.

14. The enclosure of claim 8, wherein the front panel further comprises a mechanical switch mechanism rotatably coupled to the front panel and movable between an on position and an off position, wherein the mechanical switch mechanism engages the toggle switch when the front panel is coupled to the housing.

15. The enclosure of claim 14, wherein the mechanical switch mechanism comprises two operating forks spaced a distance apart and sized to receive the toggle switch between the operating forks.

16. The enclosure of claim 15, wherein the operating forks are unequal in size.

17. The enclosure of claim 14, wherein the front panel comprises a handle coupled to the mechanical switch mechanism.

18. The enclosure of claim 17, wherein the handle is coupled to the front panel with a handle mounting bracket, the handle mounting bracket have at least one extension extending in a direction orthogonal to a surface of the front panel to a distance greater than a thickness of the handle.

19. The enclosure of claim 18, wherein the extension comprises an aperture configured to receive a means for preventing rotation of the handle.

* * * * *